United States Patent [19]

Butler

[11] Patent Number: 4,998,699

[45] Date of Patent: Mar. 12, 1991

[54] CHAIR BOOTIE

[76] Inventor: Sandra F. Butler, 2495 Ball Park Dr., Tucker, Ga. 30084

[21] Appl. No.: 454,072

[22] Filed: Dec. 21, 1989

[51] Int. Cl.[5] ..... A47B 91/00

[52] U.S. Cl. ..... 248/188.7; 248/345.1

[58] Field of Search ..... 248/188.7, 345.1, 523, 248/188.8, 188.9; 16/29, 18 CG; 297/411

[56] References Cited

U.S. PATENT DOCUMENTS

| | | | |
|---|---|---|---|
| 1,906,590 | 5/1933 | Hewson | 248/345.1 |
| 2,217,754 | 10/1940 | Johnson | 248/345.1 X |
| 3,148,855 | 9/1964 | Hamilton | 248/188.7 |
| 3,289,995 | 12/1966 | Taylor | 248/188.7 X |
| 3,922,408 | 11/1975 | Smith | 248/345.1 X |
| 3,994,466 | 11/1976 | Troup | 248/188.7 |
| 4,159,096 | 6/1979 | Chase | 248/523 |
| 4,365,839 | 12/1982 | Strassle | 297/411 |
| 4,412,667 | 11/1983 | Doerner | 248/188.9 |
| 4,598,892 | 7/1986 | Franckowiak | 248/188.7 |
| 4,744,538 | 5/1988 | Hofman | 248/188.7 X |

*Primary Examiner*—J. Franklin Foss

*Attorney, Agent, or Firm*—John L. James

[57] ABSTRACT

A bootie is provided for an office chair that has legs mounted on a shaft and rollers attached to the legs. The bootie has a top member and a skirt. The top member defines an opening for the chair shaft to pass through. The top member extends from the shaft along the leg. The skirt is connected to the top member and extends downwardly toward the wheel. The skirt is spaced from the bottom of the wheel a preselected distance. The skirt and top member form a cavity in which the chair legs and rollers fit to insulate the users shoes from contact with the rollers.

4 Claims, 3 Drawing Sheets

CHAIR BOOTIE

TECHNICAL FIELD

This invention generally relates to chairs, and more particularly, to coverings for the legs and rollers of a chair to protect them and items they contact from damage.

BACKGROUND OF THE INVENTION

Many chairs are equipped with four or five legs with rollers for easy maneuverability about a desk or other work station in an office. Typically, the chairs are constructed of wood, or metal, or both, and are susceptible to damage when the user's shoes contact the legs of the chair, as is the case when resting the feet on the legs of the chair. The user's shoes are also susceptible to damage from the legs and rollers of the chair. On wooden chairs, a metal protective rib can be placed on the back spine of a leg to prevent gouging of the wood by the user's shoe. On metal chairs, a strip of plastic or other material can be attached to the legs to prevent damage to the metal portion of the leg by the user's shoe. While these protective strips minimize damage to the leg of the chair, they are ineffective to prevent damage to the user's shoe caused by the chair legs or rollers.

The damage caused by the legs and rollers of the chair upon the user's shoes is particularly annoying because it ruins the aesthetic appeal of the shoes. Also, people often wear expensive leather shoes that are easily damaged and not easily replaced or repaired. The shoes may become damaged through normal use of the chair whether or not the user rests the shoes on the legs or rollers of the chair. When the chair is moved or scooted about on the rollers, the rollers and the legs sometimes bump the shoes gouging, scraping and scratching the leather or other material which absolutely ruins the shoes.

While the problem of shoe damage exists for both men and women, men's shoes are typically constructed of heavier gauge material that does not gouge or scar as easily as the delicate material of women's shoes. Therefore the problem is particularly acute with women's shoes. Accordingly, it will be appreciated that it would be highly desirable to have a device to help prevent damage to the user's shoes by the rollers when using modern office chairs.

A troubling aspect of the problem of shoe damage is that a person's shoes may be damaged by the chair during ordinary careful use of the chair whenever the legs or rollers come in contact with the shoes. Such contact is typically made when the chair is maneuvered into position during the ordinary course of work. The problem is very serious, causing not only the immediate damage to shoes, but a loss of productive time while repairs are contemplated or damages are commiserated. Accordingly, it will be appreciated that it would be highly desirable to have a device that prevents damage to the user's shoes without interfering with the operation of the chair.

SUMMARY OF THE INVENTION

The present invention is directed to overcoming one or more of the problems set forth above. Briefly summarized, according to one aspect of the present invention, a bootie for a chair having a shaft with a leg connected to the shaft and a wheel attached to the leg comprises a top member and a skirt. The top member defines an opening for the chair shaft to pass through. The top member extends from the shaft along the leg. The skirt is connected to the top member and extends downwardly toward the wheel. The skirt is spaced from the bottom of the wheel a preselected distance.

According to another aspect of the present invention, a bootie for a chair has a top member, a skirt connected to the top member and extending downwardly therefrom, and means for fastening one of the skirt and the top member to the chair.

It is an object of the present invention to provide an attachment for a chair to prevent the legs and rollers from damaging the user's shoes.

Another object of the invention is to provide a protective device that does not detract from the appearance of the chair.

Another object of the invention is to provide protection without interfering with the movement of the rollers.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 1:
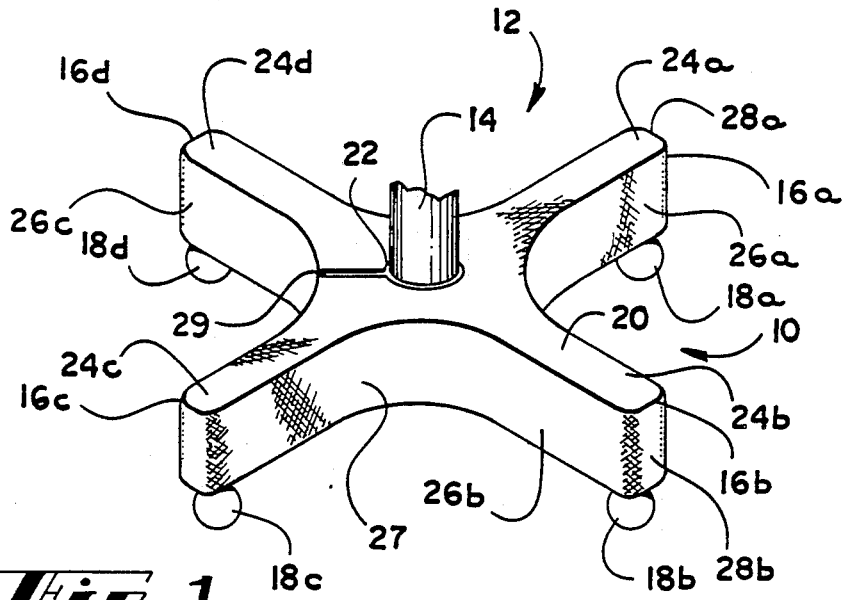
FIG. 1 is a diagrammatic perspective view of a bottom portion of a chair illustrating the legs and rollers covered by a preferred embodiment of a chair bootie constructed in accordance with the present invention.

Referring now to the drawings, in which like numerals indicate like elements throughout the several figures, FIG. 1 illustrates a bootie 10 for a chair 12 that has a shaft 14 attached to four legs 16*a–d*. Each of the four legs 16*a–d* is equipped with a respective roller 18*a–d*.

The bootie 10 includes a top member 20 with an opening 22 and a plurality of arms 24*a–d* equal in number to the number of legs 16 on the chair 12. The bootie 10 has a skirt 27 formed of side panels 26*a–d* and end panels 28*a–d*. The side panels 26*a–d* of the skirt are larger than the end panels 28*a–d*. The larger side panels 26*a–d* fit along the length of the legs 16*a–d* while the shorter panels 28*a–d* fit along the ends of the legs 16*a–d* adjacent the rollers 18*a–d*. The bootie 10 is preferably constructed of a cushioned fabric that will absorb shock such as the shock encountered when a person inadvertently bumps a shoe against the leg of the chair 12, or inadvertently rolls a roller 18 or leg 16 onto the shoe. The panels 26, 28 are preferably connected by sewing or may be formed from one continuous piece of material. The skirt 27 is connected to the arms 24 by sewing, fusing or other means for connecting materials.

When assembled, the arms 24*a–d* and skirt 27 of the bootie 10 define an interior space sufficient for accommodating the legs 16 and rollers 18 of the chair 12. The panels 26, 28 have a length sufficient for covering the legs 16 and about three quarters of the height of the wheels 18 so that the wheels 18 are free to move without binding on the skirt 27.

The top member 20 preferably has a planar configuration with a first and second longitudinal edge portions and a curved edge portion extending between the first and second longitudinal edge portions. The skirt 27 has first and second elongated planar members 26*a*, 26*b*, one for each side of the of the leg 16*a* of the chair 12, and a third curved member 28*a*. The first elongated planar member 26*a* is connected to the first longitudinal edge portion, the second elongated planar member 26*b* is connected to the second longitudinal edge portion, and the third curved member 28*a* is connected to the curved edge portion.

Alternatively, the top member 20 may have an elongated rectangular configuration with a first longitudinal edge portion, a second longitudinal edge portion, and a transverse edge portion. The skirt 27 may have first and second elongated rectangular members and a third rectangular member. The first elongated rectangular member would be connected to the first longitudinal edge portion, the second rectangular member to the second longitudinal edge portion, and the third rectangular member to the transverse edge portion.

Figure 2:
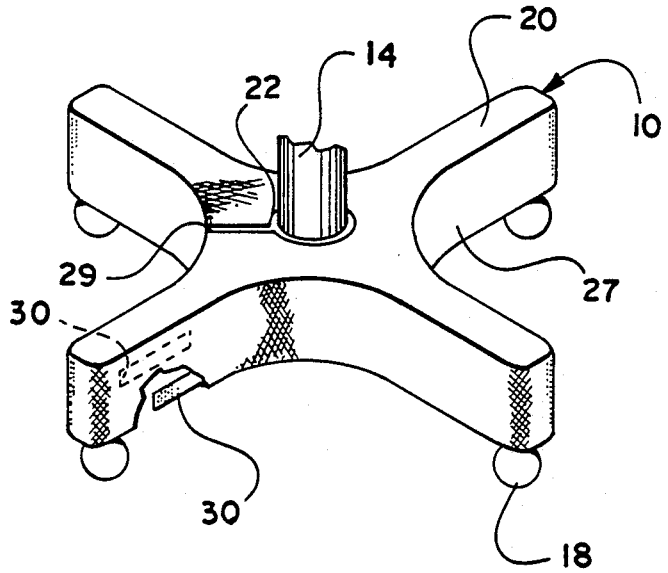
FIG. 2 is a diagrammatic perspective view similar to FIG. 1 but with portions cut away illustrating attachment of the bootie to the legs of the chair.

Referring to FIG. 2, the bootie 10 fits over the legs 16 and rollers 18 of the chair 12 with the shaft 14 of the chair 12 extending through the opening 22 of the top member 20 of the bootie 10. The opening 22 may be a continuously bounded opening requiring the bootie 10 to be slipped down over the shaft 14, or may be noncontinuously bounded or open at its slit 29 so that the bootie is slipped around the shaft 14. The skirt 27 of the bootie 10 is preferably attached to the sides of the legs by fasteners 30. Preferably, the fastening system uses VELCRO fasteners with one fastener strip adhesively mounted on the leg 16 and a mating fastener strip glued or sewn to the fabric of the skirt 27. In fasteners of this type, one fastener strip typically has a surface of tiny hooks and the other fastener strip has a pile surface. The two surfaces are mateable and interlock when pressed together. By this construction, the bootie 10 can be easily installed and removed.

Figure 3:
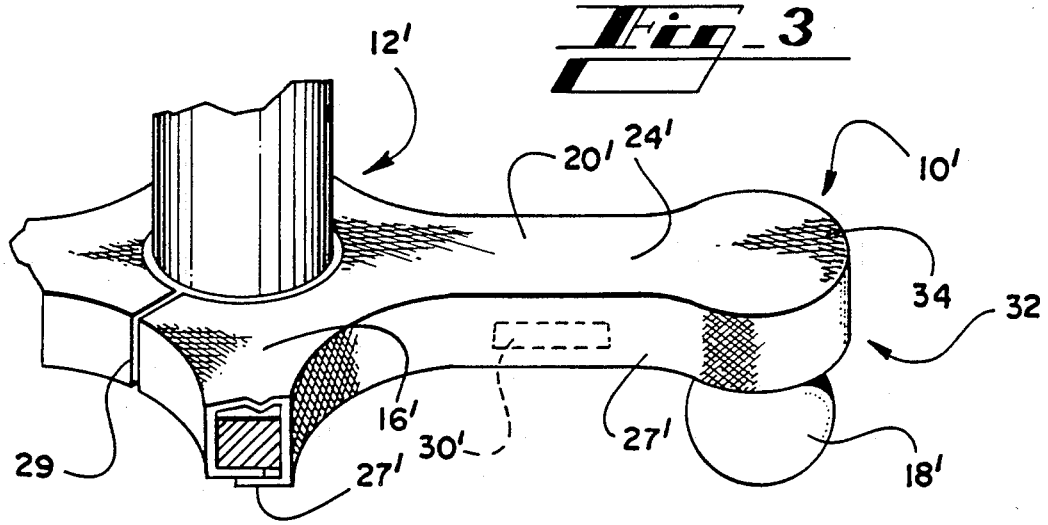
FIG. 3 is a diagrammatic view similar to FIGS. 1 and 2 but illustrating another preferred embodiment of a chair bootie constructed in accordance with the present invention.

Referring to FIG. 3, another embodiment of the bootie 10' is illustrated for a chair 12' having a plurality of legs 16'. While most office chairs will have four or five legs, there are chairs that have only three legs and some that have six or more legs depending upon the particular type of chair. The bootie 10' is adaptable to any number of legs 16'.

The bootie 10' differs from the bootie 10 in FIGS. 1 and 2 in its shape. The bootie 10' has a bulb-shaped portion 32 that fits over the leg 16' and roller 18' of the chair 12'. The top member 20' is a planar member having an arm 24' with an end portion 34 with a bulb shape similar to a cross sectional configuration of an electric lamp bulb or a flower bulb. The skirt 27' is preferably of a one-piece construction that is connected to the top member 20' along its edges to form the cavity for the chair leg 16' and roller 18'. Also, the skirt 27' may have its lower hanging panels fastened to one another underneath the leg 16' of the chair 12' forming a neat enclosure for the leg 16'. By this construction a chair bootie 10' is formed to cover the leg 16' and roller 18' of the chair 12' that does not interfere with the operation of the roller 18'. This configuration is particularly well suited for chairs with legs having claw or club feet over the rollers because the bulb-shaped bootie 10' easily covers the construction without hindering the operation of the roller 18'. Also, the bulb-shaped bootie 10' is aesthetically appealing.

Figure 4:
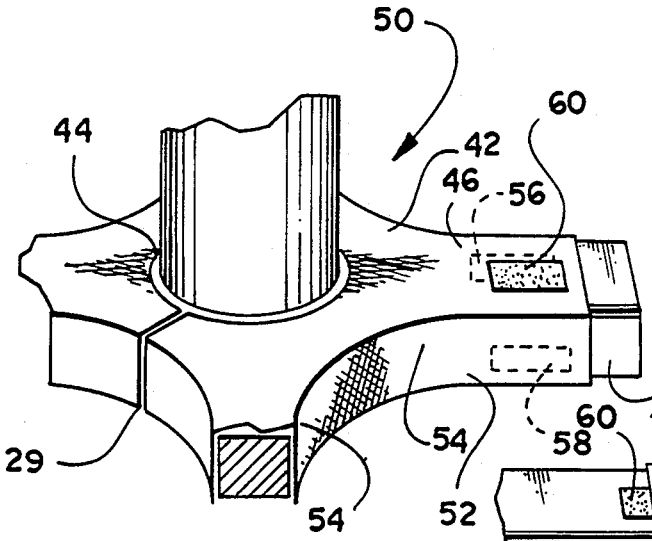
FIG. 4 is a diagrammatic perspective view similar to FIGS. 1–3, but illustrating another perferred embodiment of a chair bootie constructed in accordance with the present invention.
Figure 5:
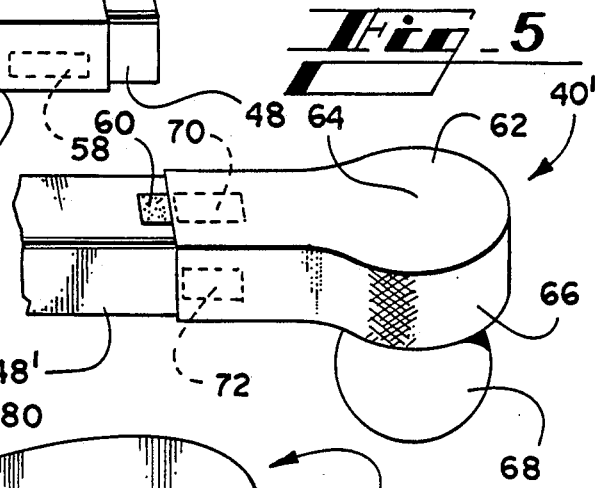
FIG. 5 is a diagrammatic perspective view, similar to FIGS. 1–3, and, with FIG. 4, illustrates an embodiment of a chair bootie having two parts, the first part being illustrated in FIG. 4 and the second part being illustrated in FIG. 5.

Referring now to FIGS. 4 and 5, another bootie is illustrated that has two parts. The first part is shown in FIG. 4 where the bootie sleeve 40 includes a top member 42 with an opening 44 and a number of arms 46 equal to the number of legs 48 on the chair 50. The sleeve 40 has a skirt 52 formed of side panels 54 attached to the top member 42. The panels 54 and arms 46 are sufficient in length to cover only a portion of the length of the leg 48 of the chair 50. Preferably, the sleeve 40 covers about three quarters of the length of the leg 48. Each arm 46 may be secured to the chair leg 48 with fasteners 56. Similarly, the skirt 52 may be secured to the legs 48 with fasteners 58. A fastener 60 is also attached to the top surface of the arm 46 near its distal end, or to the top surface of the chair leg 48.

Referring to FIG. 5, the second part of the bootie is the bulb or boot 62. The boot 62 has a top member 64 and a skirt 66 attached to the top member 64 along three of the edges of the top member 64 forming a cavity for a portion of the chair leg 48 and roller 68. The boot 62 may be bulb-shaped, or it may be rectangularly shaped, or may have any other configuration that covers the leg 48 and wheel 68 without interfering with their operation. The length of the boot 62 is such that it is at least about one quarter the length of the chair leg 48. By this construction the boot 62 overlays and overlaps the sleeve 40 so that the leg 48 is completely covered. The boot 62 is preferably attached by fastener 70 to fastener 60 located on the top surface of the arm 46. The fastener 70 is located on the underside of the top member 64 of the sleeve 40. The skirt 66 may also be connected by fasteners 72 to the chair leg 48 or to the skirt 52 of the bootie (FIG. 4).

Alternatively, the boot 62 may be fastened only to the chair leg 48 and used without the sleeve 40. This would be advantageous to save labor and material when roller protection alone is desired. Also, the combination of overlapping boot 62 and sleeve 40 is adaptable to legs of different lengths providing a one-size-fits-all bootie.

Figure 6:
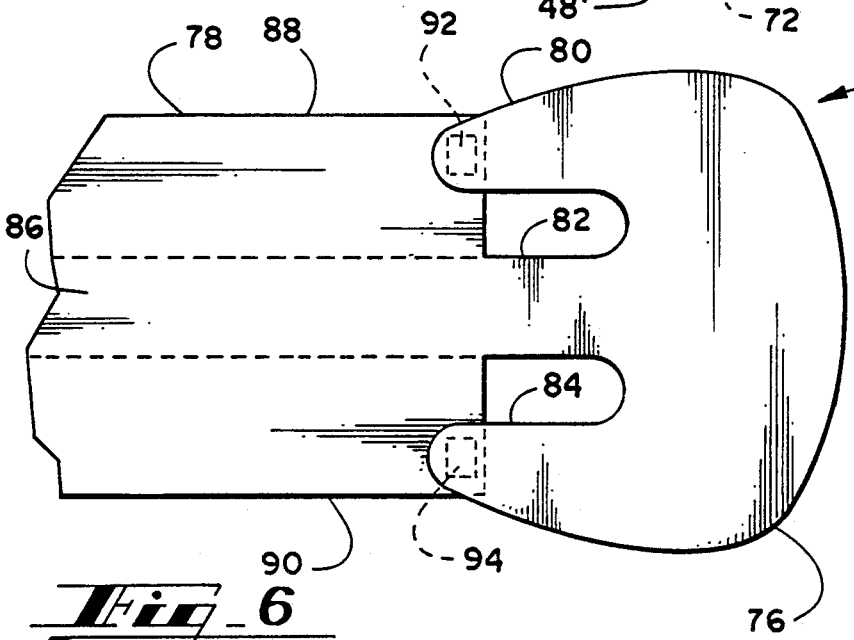
FIG. 6 is a plan view of a chair bootie prior to installation and illustrates another preferred embodiment.
Figure 7:
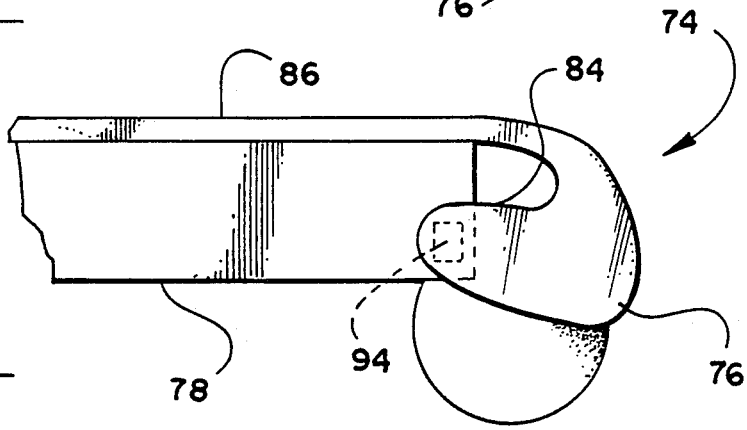
FIG. 7 is the chair bootie illustrated in FIG. 6 installed on a chair.

Referring now to FIGS. 6 and 7, the bootie 74 contains two parts, a boot 76 and a sleeve 78. Before assembly, the boot 76 is flat resembling a foot with three toes 80, 82, 84 protruding from the foot. The sleeve 78 has a top member 86 and side skirts 88 and 90 attached thereto. The top member 86 and middle toe 82 are connected together and may be formed from a single piece of material. When installed, the top member 86 rides on the spine of the leg while the side skirts 88, 90 hang downwardly from the top member 86 along the sides of the chair leg. The outer toes 80, 84 preferably attach to the side skirts 88, 90 with fasteners 92, 94, respectively. When connected, the boot 76 is formed because the shorter toes 80, 84 cup the foot to fit around the wheel of the chair. The side skirt 88, 90 may also be fastened to the chair legs. The sleeve 78 need only be long enough to support the boot 76 in the installed position, but may be longer to cover a portion, or even all, of the leg.

Figure 8:
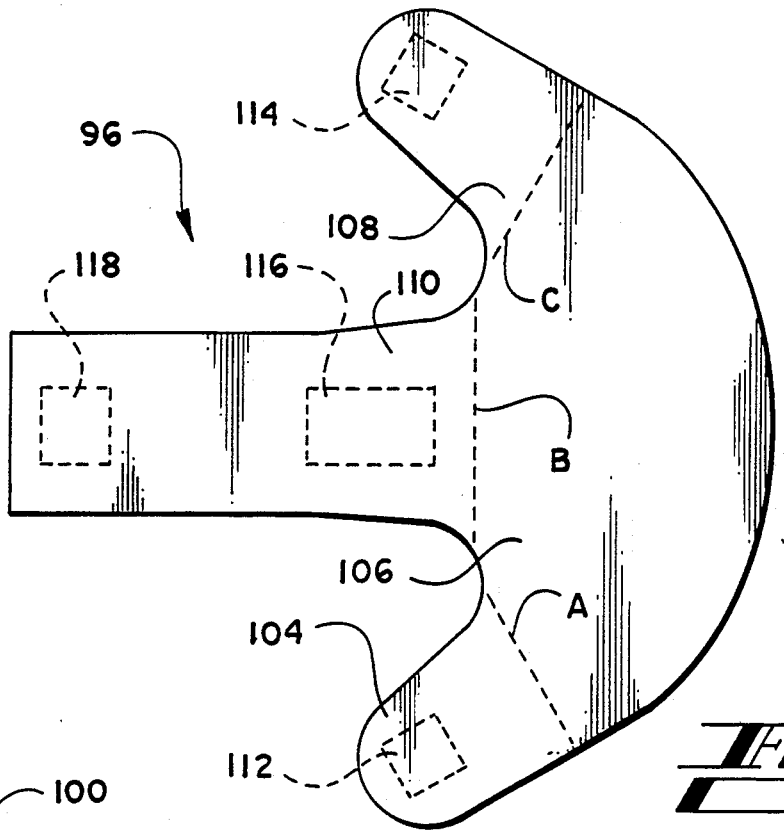
FIG. 8 is a plan view similar to FIG. 6, but illustrating another preferred embodiment flatten before formation.
Figure 10:
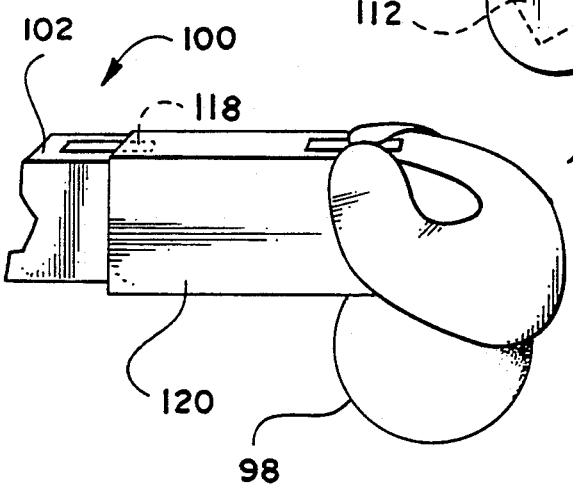
FIG. 10 illustrates the chair bootie of FIGS. 8 and 9 installed on a chair.
Figure 9:
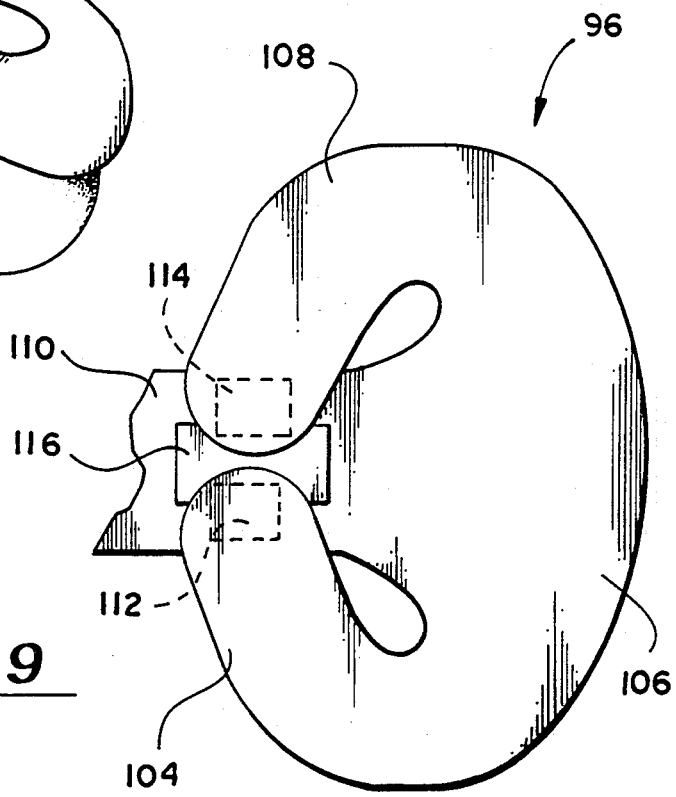
FIG. 9 illustrates the chair bootie of FIG. 8 folded and formed into a cap prior to installation.

Referring to FIGS. 8–10, another embodiment of the present invention is illustrated wherein the bootie 96 is designed to fit over the wheel 98 area of the chair 100 and, alternatively, along the back spine of the legs 102. The bootie 96 is constructed from a flat piece of material having a general mushroom appearance that is divided into four segments 104, 106, 108 and 110. Segments 104 and 106 are separated by dashed fold line A, segments 106 and 108 are separated by dashed fold line C, and dash fold line B separates segment 110 from segments 104, 106, and 108. The material is gently folded along the fold lines into a bulb or cup-like configuration forming a cavity for fitting over the roller 98 of the chair 100. The bulb shape is held by fasteners 112, 114 and 116 on segments 104, 108 and 110, respectively.

The segment 110 helps to form the cup and preferably has a length sufficient for extending along the back spine 102 of the leg containing the wheel 98 over which the bootie structure is placed. Preferably, the back spine of the leg 102 and the underside of member 110 are equipped with fasteners 118. A sleeve 120 may be used with the bootie 90 when desired to cover all or only a portion of the leg.

It will be now appreciated that there has been presented a protective device for a chair that protects both the chair and the user. The protective device is a bootie that has a top member and a skirt connected to the top member and extending downwardly therefrom forming a protective cup.

While the invention has been described with reference to an office chair with rollers, it is apparent that the invention is easily adapted to other chairs and devices with rollers mounted on legs.

While the invention has been described with particular reference to a preferred embodiment, it will be understood by those skilled in the art that various changes may be made and equivalents may be substituted for elements of the preferred embodiment without departing from invention. In addition, many modifications may be made to adapt a particular situation and material to a teaching of the invention without departing from the essential teachings of the present invention.

As is evident from the foregoing description, certain aspects of the invention are not limited to the particular details of the examples illustrated, and it is therefore contemplated that other modifications and applications will occur to those skilled the art. For example, other types of fasteners may be used rather than the particular fasteners described herein. It is accordingly intended that the claims shall cover all such modifications and applications as do not depart from the true spirit and scope of the invention.

I claim:

1. A bootie for a chair having a shaft with a leg connected to said shaft and a wheel attached to said leg, comprising:

a top member defining an opening of a size sufficient for said shaft to pass through, said top member extending from said shaft along said leg;

a first fastener strip mounted on said leg;

a second, mating fastener strip attached to said top member, one of said fastener strips having a surface of tiny hooks and the other of said fastener strips having a pile surface, said surfaces being mateable and releasably interlocking when pressed together; and a skirt connected to said top member and extending downwardly therefrom toward said wheels, said top member and said skirt substantially covering said leg and said wheel; and wherein: said top member has an elongated rectangular configuration with a first longitudinal edge portion, a second longitudinal edge portion, and a tranverse edge portion; and wherein said skirt has a first and second elongated rectangular member and a third rectangular member, said first elongated rectangular member being connected to said first longitudinal edge portion, said second elongated rectangular member being connected to said second longitudinal edge portion, said third rectangular member being connected to said tranverse edge portion:

2. A bootie, as set forth in claim 1, wherein said skirt is spaced from the bottom of said wheel a distance equal to about one fourth the height of said wheel.

3. A bootie, as set forth in claim 1, wherein said skirt has a first and second elongated planar members connected to said top member and hanging downwardly therefrom and being connected to one another underneath said leg of said chair.

4. A bootie, as set forth in claim 1, wherein said top member and said skirt form a protective cup.

* * * * *